US011326789B2

(12) United States Patent
Liu et al.

(10) Patent No.: US 11,326,789 B2
(45) Date of Patent: May 10, 2022

(54) AIR CONDITIONING SYSTEM AND CONTROL METHOD THEREOF

(71) Applicant: Carrier Corporation, Palm Beach Gardens, FL (US)

(72) Inventors: Hongsheng Liu, Shanghai (CN); Yinshan Feng, Manchester, CT (US); Frederick J. Cogswell, Glastonbury, CT (US); Parmesh Verma, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 108 days.

(21) Appl. No.: 16/842,298

(22) Filed: Apr. 7, 2020

(65) Prior Publication Data

US 2020/0318839 A1 Oct. 8, 2020

(30) Foreign Application Priority Data

Apr. 8, 2019 (CN) ..... 201910276085.9

(51) Int. Cl.
*F24F 3/06* (2006.01)
*F24F 11/83* (2018.01)
*F24F 13/30* (2006.01)

(52) U.S. Cl.
CPC ..... *F24F 3/065* (2013.01); *F24F 11/83* (2018.01); *F24F 13/30* (2013.01)

(58) Field of Classification Search
CPC . F24F 3/065; F24F 11/83; F24F 13/30; F25B 7/00; F25B 9/008; F25B 40/02;
(Continued)

(56) References Cited

U.S. PATENT DOCUMENTS 10,603,985 B2 * 3/2020 Nishijima ..... B60H 1/3223
2008/0141711 A1 6/2008 Roberts et al.
(Continued)

FOREIGN PATENT DOCUMENTS

DE 19904822 C1 * 5/2000 ..... F25B 1/08
DE 19904822 C1 5/2000
(Continued)

OTHER PUBLICATIONS

Boyaghchi; "A Comparative Study on Exergetic, Exergeoeconomic and Exergoenvironmental Assessments of Two Internal Auto-Cascade Refridgeration Cycles", Applied Thermal Engineering, Pergamon, Oxford, vol. 122, May 17, 2017, pp. 723-737.
(Continued)

*Primary Examiner* — Marc E Norman
(74) *Attorney, Agent, or Firm* — Cantor Colburn LLP

(57) ABSTRACT

An air conditioning system and a control method thereof. The air conditioning system includes a main circuit and a first subcooling circuit, wherein the main circuit has: a main compressor and an injector; a gas cooler and a gas-liquid separator connected between the main compressor and the injector; and a main throttling element and an evaporator connected between the gas-liquid separator and the injector; and wherein the first subcooling circuit has: a first subcooling compressor, a first condenser, a first subcooling throttling element and a first subcooler connected in sequence; wherein the first subcooler is further disposed in a flow path between the outlet of the injector and the gas-liquid separator.

10 Claims, 2 Drawing Sheets

(58) Field of Classification Search
CPC ..... F25B 2341/00; F25B 2341/001; F25B 2341/0013
See application file for complete search history.

(56) References Cited

U.S. PATENT DOCUMENTS

| | | | | |
|---|---|---|---|---|
| 2012/0116594 | A1* | 5/2012 | Aidoun | F25B 27/002 700/276 |
| 2019/0118618 | A1* | 4/2019 | Elsherbini | F25B 7/00 |
| 2020/0049383 | A1* | 2/2020 | Morita | F25B 40/02 |
| 2020/0248938 | A1* | 8/2020 | Liu | F25B 27/02 |

FOREIGN PATENT DOCUMENTS

| | | | |
|---|---|---|---|
| EP | 2754978 | A1 | 7/2014 |
| WO | 2016018692 | A1 | 2/2016 |
| WO | 2016180487 | A1 | 11/2016 |
| WO | 2018118609 | A1 | 6/2018 |

OTHER PUBLICATIONS

European Search Report for Application No. 20166454.7; dated Aug. 25, 2020; 7 Pages.

* cited by examiner

AIR CONDITIONING SYSTEM AND CONTROL METHOD THEREOF

FOREIGN PRIORITY

This application claims priority to Chinese Patent Application No. 201910276085.9, filed Apr. 8, 2019, and all the benefits accruing therefrom under 35 U.S.C. § 119, the contents of which in its entirety are herein incorporated by reference.

FIELD OF THE INVENTION

The present disclosure relates to the field of air conditioning, and in particular to an air conditioning system and a control method thereof.

BACKGROUND OF THE INVENTION

At present, more and more large-scale scenes with refrigeration requirements in commercial applications are using carbon dioxide type air conditioning systems with injectors. On one hand, natural refrigerants including carbon dioxide have better environmental friendliness. On the other hand, injecting air conditioning systems typically have a simple structure and a small volume, and can be applied to a large-temperature-difference environment. In addition, multiple sets of parallel injectors can be used to obtain better partial-load regulation and operating efficiency. Of course, for such an air conditioning system with injectors, how to further improve its system performance and improve energy efficiency has become the research and application objects.

SUMMARY OF THE INVENTION

In view of this, an air conditioning system and a control method thereof are provided by the present disclosure, thereby effectively solving or at least alleviating one or more of the above problems in the prior art and in other aspects.

In order to achieve at least one object of the present disclosure, an air conditioning system is provided according to an aspect of the present disclosure, which includes a main circuit and a first subcooling circuit, wherein the main circuit has: a main compressor and an injector; a gas cooler connected between an exhaust port of the main compressor and a primary flow inlet of the injector; a gas-liquid separator connected between a suction port of the main compressor and an outlet of the injector; and a main throttling element and an evaporator connected between a liquid outlet of the gas-liquid separator and a secondary flow inlet of the injector; and wherein the first subcooling circuit has: a first subcooling compressor, a first condenser, a first subcooling throttling element and a first subcooler connected in sequence; wherein the first subcooler is further disposed in a flow path between the outlet of the injector and the gas-liquid separator in the main circuit.

Optionally, the first subcooling circuit further includes a second subcooler which is connected in parallel with the first subcooler; wherein the second subcooler is further disposed between the primary flow inlet of the injector and the gas cooler in the main circuit.

Optionally, the air conditioning system further includes a second throttling element, wherein the second throttle element and the second subcooler are connected in parallel with the first throttling element and the first subcooler.

Optionally, the air conditioning system further includes a back pressure valve connected in parallel with the first subcooler and disposed between the second subcooler and an exhaust port of the first subcooling compressor.

Optionally, the first subcooling circuit further includes a second subcooler connected in series with the first subcooler; wherein the second subcooler is further disposed between the primary flow inlet of the injector and the gas cooler in the main circuit.

Optionally, the air conditioning system further includes a second subcooling circuit having a second subcooling compressor, a second condenser, a second subcooling throttling element, and a second subcooler connected in sequence; wherein the second subcooler is further disposed between the primary flow inlet of the injector in the main circuit and the gas cooler.

Optionally, the air conditioning system further includes a suction line heat exchanger disposed in a flow path between the gas cooler and the primary flow inlet of the injector; wherein a refrigerant flowing out of a gas outlet of the gas-liquid separator flows into the suction port of the main compressor via the suction line heat exchanger.

Optionally, the air conditioning system further includes a liquid pump disposed in a flow path between the liquid outlet of the gas-liquid separator and the secondary flow inlet of the injector.

Optionally, the liquid pump is disposed between the liquid outlet of the gas-liquid separator and the main throttling element.

Optionally, the refrigerant participating in the operation in the main circuit is a carbon dioxide refrigerant.

Optionally, the refrigerant participating in the operation in the first subcooling circuit or the second subcooling circuit is a propane refrigerant.

Optionally, the air conditioning system includes a cooling system, a heat pump system, or a refrigeration/freezing system.

In order to achieve at least one object of the present disclosure, according to another aspect of the present disclosure, a control method for an air conditioning system is further provided, which is used for the air conditioning system described above, wherein the control method includes: starting the first subcooling circuit when the main circuit is in operation.

Optionally, when the air conditioning system has a second subcooling circuit, the control method further includes: starting the second subcooling circuit when the main circuit is in operation.

According to the air conditioning system of the present disclosure and the control method thereof, a two-phase flow of refrigerant flowing out of the outlet of the injector of the main circuit is further cooled by the first subcooling circuit disposed downstream of the injector, so that part of the gas-phase refrigerant is further condensed into a liquid-phase refrigerant; as a result, the proportion of the liquid-phase refrigerant that subsequently enters the evaporator to participate in heat exchange is increased, thereby effectively improving the system performance and energy efficiency thereof.

BRIEF DESCRIPTION OF THE DRAWINGS

The technical solutions of the present disclosure will be further described in detail below with reference to the accompanying drawings and embodiments, but it should be understood that the drawings are only provided for the purpose of explanation, and should not be considered as limiting the scope of the present disclosure. In addition, unless otherwise specified, the drawings are only intended to conceptually illustrate the structures and constructions described herein, and are not necessarily drawn to scale.

DETAILED DESCRIPTION OF THE EMBODIMENT(S) OF THE INVENTION

Figure 1:
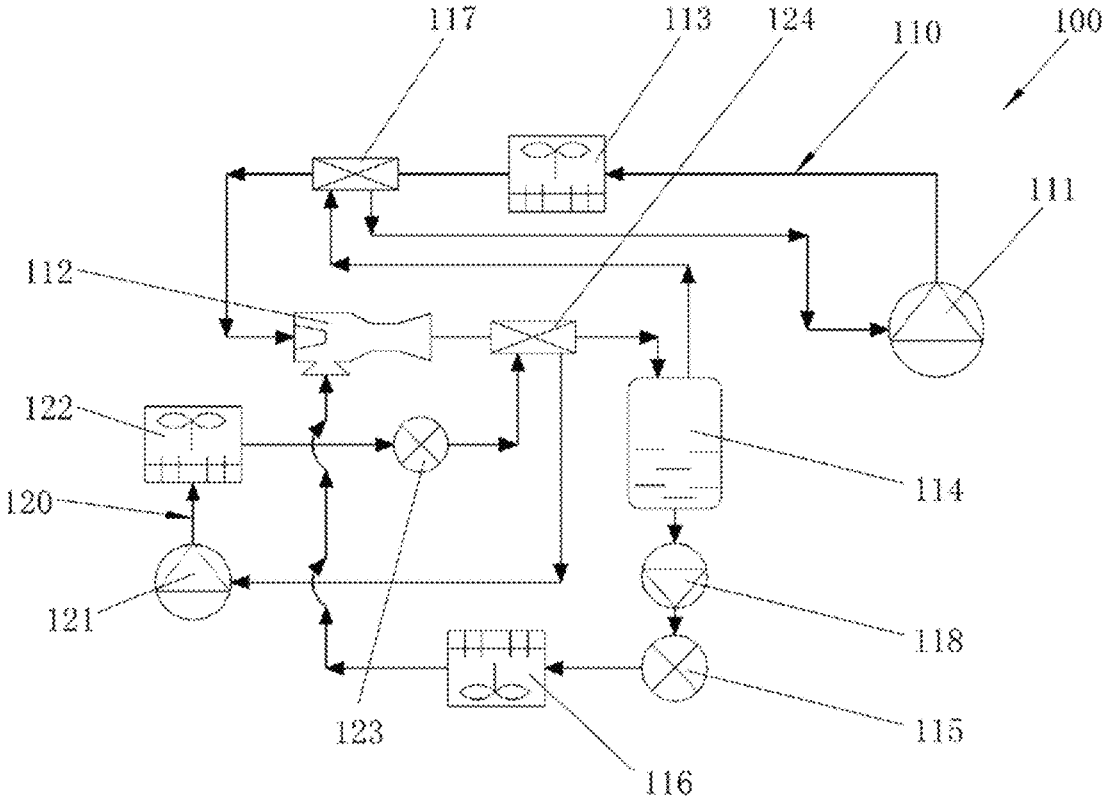
FIG. 1 is a schematic diagram of an embodiment of an air conditioning system according to the present disclosure.

The present disclosure will be described in detail below with reference to the exemplary embodiments in the drawings. However, it should be understood that the present disclosure may be embodied in a variety of different forms and should not be construed as being limited to the embodiments set forth herein. The embodiments are provided to make the disclosure of the present disclosure more complete and thorough, and to fully convey the concept of the present disclosure to those skilled in the art.

It should also be understood by those skilled in the art that the air conditioning system proposed by the present disclosure does not narrowly refer to an air conditioner in the industry which is used in a building and equipped with an outdoor cooling/heating unit and an indoor heat exchange unit. Rather, it should be considered as a kind of thermodynamic system with air conditioning function, which is driven by various types of power sources (for example, electric power) to exchange heat with the air at a position to be conditioned, by means of a phase change of the refrigerant in the system. For example, when the air conditioning system is used in a Heating Ventilating & Air Conditioning (HVAC) system in a building, it may be a cooling system with a cooling-only function or a heat pump system with both cooling and heating functions. As another example, when the air conditioning system is used in the field of cold chain, it may be a transport cooling system or a refrigeration/freezing system. However, regardless of which form the air conditioning system is in, an injector should be present so as to be suitable for the concept of the present disclosure.

Referring to FIG. 1, an embodiment of an air conditioning system is illustrated. The air conditioning system 100 includes a main circuit 110 and a first subcooling circuit 120. The main circuit 110 of the air conditioning system 100 includes a main compressor 111 for compressing gas and an injector 112 for initially compressing a refrigerant fluid before the refrigerant fluid enters the main compressor 111, thereby increasing a suction pressure of the fluid entering the main compressor 111. The main circuit further includes a gas cooler 113 connected between an exhaust port of the main compressor 111 and a primary flow inlet of the injector 112, a gas-liquid separator 114 connected between a suction port of the main compressor 111 and an outlet of the injector 112, and a main throttling element 115 (e.g., an expansion device) and an evaporator 116 connected between a liquid outlet of the gas-liquid separator 114 and a secondary flow inlet of the injector 112.

In addition, the first subcooling circuit 120 of the air conditioning system 100 includes a first subcooling compressor 121, a first condenser 122, a first subcooling throttling element 123, and a first subcooler 124 that are connected in sequence to form a closed loop. The first subcooler 124 mentioned herein is also disposed in a flow path between the outlet of the injector 112 and the gas-liquid separator 114 in the main circuit 110, thereby providing space for the heat exchange between the refrigerant in the main circuit and the refrigerant in the first subcooling circuit.

In this arrangement, a two-phase flow of refrigerant flowing out of the outlet of the injector 112 of the main circuit 110 in the air conditioning system 100 is further cooled by the first subcooling circuit 120 disposed downstream of the injector 112, so that part of the gas-phase refrigerant is further condensed into a liquid-phase refrigerant; as a result, the proportion of the liquid-phase refrigerant that enters the evaporator 116 to participate in heat exchange is increased, thereby effectively improving the air conditioning system performance and energy efficiency thereof.

Regarding the embodiment of the above air conditioning system, the refrigerant participating in the operation of the main circuit 110 may be a carbon dioxide refrigerant, which has good environmental friendliness, stable chemical property, non-toxicity, non-combustibility, and good latent heat of vaporization. In addition, the refrigerant participating in the operation of the first subcooling circuit 120 may be a propane refrigerant, which has a better compression ratio and is used to effectively improve system performance when providing supercooling for the main circuit. Moreover, the system in which the propane refrigerant is applied can be arranged in a machine room or outdoors, and a coolant is used to transfer cold to the first subcooler 124 so that the system reliability can also be improved with no need for the refrigerant to flow directly through the application site (for example, a supermarket, etc.) where the evaporator is arranged.

In addition, in order to further improve the energy efficiency or reliability of the system, some additional components may be added, as will be exemplified below.

For example, a suction line heat exchanger 117 may be disposed in a flow path between the gas cooler 113 and the primary flow inlet of the injector 112 in the air conditioning system, and the refrigerant flowing out of the gas outlet of the gas-liquid separator 114 flows into the suction port of the main compressor 111 after flowing through the suction line heat exchanger 117. Under this arrangement, the gas-phase refrigerant flowing out of the gas outlet of the gas-liquid separator 114 first absorbs a part of the heat from a supercritical-state or the liquid-state refrigerant downstream of the gas cooler 113 before entering the main compressor 111. On one hand, this causes the aforementioned refrigerant to recover a part of the cold, thereby contributing to the improvement of energy efficiency, and on the other hand, the temperature of the aforementioned gas-phase refrigerant is further raised, thereby facilitating evaporation of a small amount of liquid-phase droplets mixed in the aforementioned gas-phase refrigerant, and preventing them from entering the main compressor to cause liquid hammering.

In another example, a liquid pump 118 may be disposed in the flow path between the liquid outlet of the gas-liquid separator 114 and the secondary flow inlet of the injector 112. More specifically, the liquid pump 118 is disposed between the liquid outlet of the gas-liquid separator 114 and the main throttling element 115 to provide a driving force to the liquid-phase refrigerant flowing out of the liquid outlet of the gas-liquid separator 114 when the driving force provided by the injector is insufficient, so that the liquid-phase refrigerant enters the evaporator 116 for heat exchange; and if the injector has sufficient driving force, the liquid pump may not participate in operation.

Figure 2:
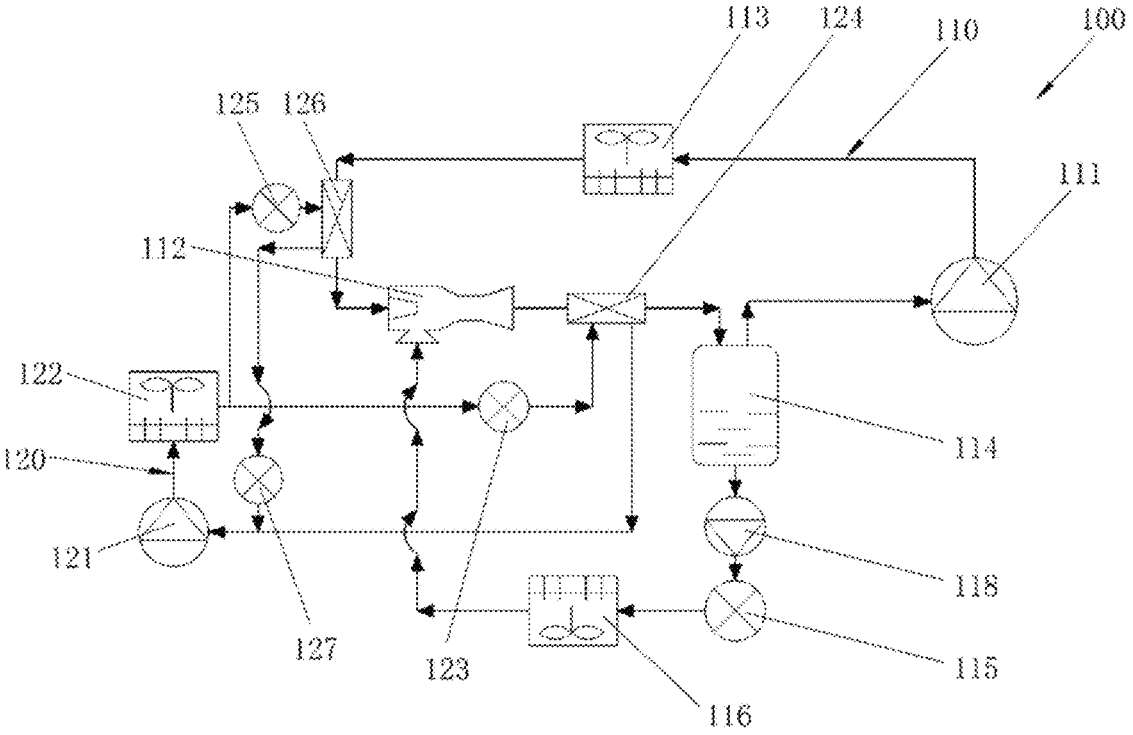
FIG. 2 is a schematic diagram of another embodiment of an air conditioning system according to the present disclosure.

Referring to FIG. 2, another embodiment of an air conditioning system is shown. In this case, the first subcooling circuit of the air conditioning system has two parallel subcooling branches, one of which is provided with a first subcooler 124 that is still disposed in the flow path between the outlet of the injector 112 and the gas-liquid separator 114 in the main circuit 110, and the other of which is provided with a second subcooler 126 that is also disposed between the primary flow inlet of the injector 112 and the gas cooler 113 in the main circuit 110 and further cools the refrigerant entering the injector 112, thus reducing the refrigerant enthalpy at the primary flow inlet of the injector 112. On one hand, this increases a primary flow rate of the refrigerant passing through a nozzle of the injector, and on the other hand, the proportion of liquid-phase refrigerant at the injector outlet will also be increased to help increase the cooling capacity and efficiency.

In this arrangement, on one hand, a two-phase flow of refrigerant flowing out of the outlet of the injector 112 of the main circuit 110 in the air conditioning system 100 is further cooled by the first subcooler 124 disposed downstream of the injector 112, so that part of the gas-phase refrigerant is further condensed into a liquid-phase refrigerant; as a result, the proportion of the liquid-phase refrigerant that subsequently enters the evaporator 116 to participate in heat exchange is increased, thereby effectively improving the air conditioning system performance and energy efficiency thereof; and on the other hand, by disposing the second subcooler 126 upstream of the injector 112 of the main circuit 110, the refrigerant flowing out of the gas cooler 113 further absorbs the cold, which contributes to additionally improving the energy efficiency of the system.

On this basis, a second throttling element 125 may also be disposed in another branch connected in parallel with the first subcooler and provides different throttling degrees for the first subcooler 124 and the second subcooler 126 as needed. Similarly, a back pressure valve 127 may be disposed between the second subcooler 126 in another branch connected in parallel with the first subcooler and the suction port of the first subcooling compressor 121 to control the passage of this branch or keep its pressure constant.

Figure 3:
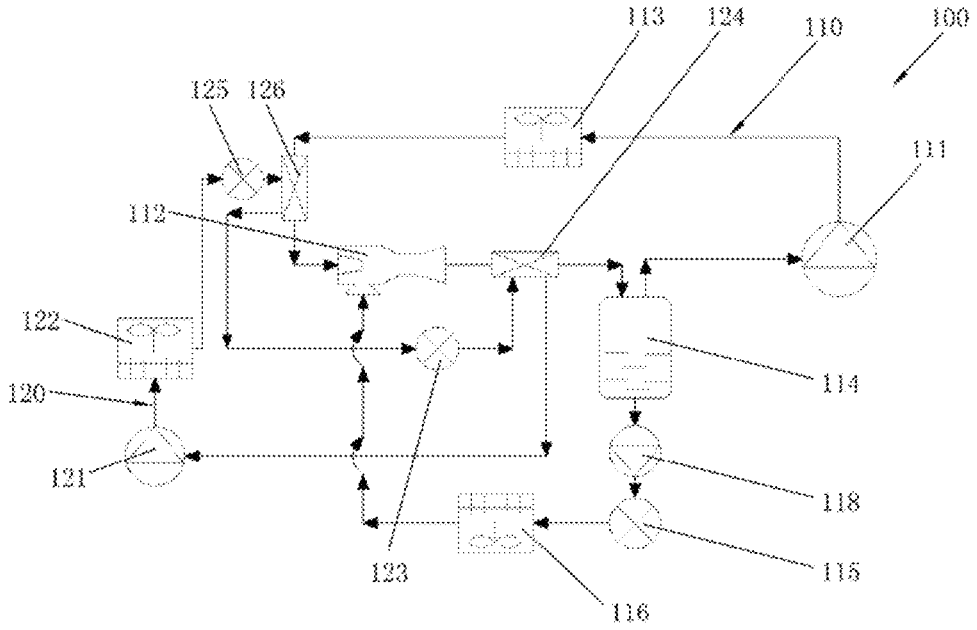
FIG. 3 is a schematic diagram of further another embodiment of an air conditioning system according to the present disclosure.

Further, referring again to FIG. 3, another embodiment of an air conditioning system is further provided herein. In this embodiment, the air conditioning system has the first subcooling circuit of the previous embodiment, and the first subcooler 124 and the second subcooler 126 are disposed in series in the first subcooling circuit. The second subcooler is also disposed between the primary flow inlet of the injector and the gas cooler in the main circuit. Since the evaporation temperature of the second subcooler 126 disposed upstream of the injector is generally higher than the evaporation temperature of the first subcooler disposed downstream of the injector, it is also possible for the refrigerant flowing out of the gas cooler to further absorb cold, which is helpful for additionally increasing energy efficiency of the system. In the parallel arrangement of the subcoolers in the previous embodiment, it is easier to control the allocation of the cold, but a back pressure valve should be typically equipped to balance the pressures in the two parallel flow paths; whereas in the series arrangement, there is a higher requirement on the allocation of the cold, but the need for a back pressure valve is eliminated.

Similarly, further another embodiment of an air conditioning system not shown in the drawings is also provided herein. In this embodiment, the air conditioning system also has the first subcooling circuit including at least the first subcooler in the previous embodiments, and it further has a second subcooling circuit. The second subcooling circuit includes a second subcooling compressor, a second condenser, a second subcooling throttling element, and a second subcooler that are connected in sequence. The second subcooler is also disposed between the primary flow inlet of the injector and the gas cooler in the main circuit, and it is also possible for the refrigerant flowing out of the gas cooler to further absorb cold, which is helpful for additionally increasing energy efficiency of the system.

Regarding the embodiments of the above air conditioning system, the refrigerant participating in the operation of the main circuit 110 may be a carbon dioxide refrigerant, which has good environmental friendliness, stable chemical property, non-toxicity, non-combustibility, and good latent heat of vaporization. In addition, the refrigerant participating in the operation of the second subcooling circuit may be a propane refrigerant, which has a better compression ratio and is used to effectively improve system performance when providing supercooling for the main circuit. Moreover, the system in which the propane refrigerant is applied can be arranged in a machine room or outdoors, so that the system reliability can also be improved with no need for the refrigerant to flow directly through the application site (for example, a supermarket, etc.) where the evaporator is arranged.

A control method for an air conditioning system, which can be used in the air conditioning system of any of the foregoing embodiments or combinations thereof, is continuedly described herein in connection with FIG. 1. Specifically, the control method includes starting the first subcooling circuit 120 when the main circuit 110 is in operation. At this point, the refrigerant in the main circuit 110 is compressed by the main compressor 111 and then flows into the gas cooler 113 to be cooled, and subsequently flows through the suction line heat exchanger 117 to be further cooled by the gas-phase refrigerant from the separator. Then, it enters the injector 112 via the primary flow inlet, mixes in the injector 12 with the gas-phase refrigerant entering the injector 112 from the secondary flow inlet, is ejected from the outlet of the injector 112 after being initially compressed by the injector and forming a mixed two-phase flow, and then passes through the first subcooler 124. At the same time, the propane refrigerant in the first supercooling circuit 120 is compressed by the supercooling compressor 121 and then flows through the first condenser 122 to be cooled, and subsequently flows through the first subcooler 124 after passing through the first subcooling throttling element 123 for expansion throttling. The propane refrigerant cools the carbon dioxide mixed two-phase refrigerant in the first subcooler 124, further condenses part of the gas-phase refrigerant into a liquid-phase refrigerant, and increases the proportion of the carbon dioxide liquid-phase refrigerant. Then, the propane refrigerant returns to the first supercooling compressor 121, and a new cycle is started. The cooled carbon dioxide mixed two-phase refrigerant continues to enter the gas-liquid separator 114 for gas-liquid separation. The liquid-phase refrigerant having an increased proportion due to supercooling is throttled by the main throttling element 115 when driven by the liquid pump 118, and flows into the evaporator 116 to participate in heat exchange. Since the amount of refrigerant participating in the heat exchange is increased, the heat exchange capacity and efficiency thereof can also be correspondingly increased. This part of the refrigerant enters the secondary flow inlet of the injector 112 after completion of heat exchange and participates in the refrigerant mixing and initial compression process. The gas-phase refrigerant having a decreased proportion due to supercooling flows out of the gas outlet of the gas-liquid separator 114, and passes through the suction line heat exchanger 117 to further cool the refrigerant flowing out of the gas cooler 113. After part of the heat is recovered, the gas-phase refrigerant enters the compressor 111 to participate in a new cycle, and meanwhile liquid hammering is also effectively avoided.

With continued reference to FIG. 2, if the first subcooling circuit in the system now has another branch, the refrigerant in the main circuit 110 is compressed by the main compressor 111 and then flows into the gas cooler 113 to be cooled. Then, it flows through the second subcooler 126. At the same time, the propane refrigerant in the first subcooling circuit 120 is compressed by the supercooling compressor 121 and then flows through the first condenser 122 to be cooled, and subsequently flows through the second subcooler 126 after passing through the second supercooling throttling element 125 for expansion throttling. The propane refrigerant cools the carbon dioxide refrigerant in the second subcooler 126 to lower its enthalpy, and then flows through the back pressure valve 127 and returns to the first subcooling compressor 121 to start a new cycle. The cooled carbon dioxide refrigerant then enters the injector 112 from the primary flow inlet, mixes in the injector 112 with the gas-phase refrigerant entering the injector 112 from the secondary flow inlet, is ejected from the outlet of the injector 112 after being initially compressed by the injector and forming a mixed two-phase flow, and then passes through the first subcooler 124. At the same time, the propane refrigerant in the first supercooling circuit 120 is compressed by the supercooling compressor 121 and then flows through the first condenser 122 to be cooled, and subsequently flows through the first subcooler 124 after passing through the first subcooling throttling element 123 for expansion throttling. The propane refrigerant cools the carbon dioxide mixed two-phase refrigerant in the first subcooler 124, further condenses part of the gas-phase refrigerant into a liquid-phase refrigerant, and increases the proportion of the carbon dioxide liquid-phase refrigerant. Then, the propane refrigerant returns to the first supercooling compressor 121, and a new cycle is started. The cooled carbon dioxide mixed two-phase refrigerant continues to enter the gas-liquid separator 114 for gas-liquid separation. The liquid-phase refrigerant having an increased proportion due to supercooling is throttled by the main throttling element 115 when driven by the liquid pump 118, and flows into the evaporator 116 to participate in heat exchange. Since the amount of refrigerant participating in the heat exchange is increased, the heat exchange capacity and efficiency thereof can also be correspondingly increased. This part of the refrigerant enters the secondary flow inlet of the injector 112 after completion of heat exchange and participates in the refrigerant mixing and initial compression process. The gas-phase refrigerant having a decreased proportion due to supercooling flows out of the gas outlet of the gas-liquid separator 114, and enters the compressor 111 to participate in a new cycle.

Further, although not shown in the drawings, another control method for an air conditioning system is provided herein, wherein the air conditioning system 100 further has a second subcooling circuit. Specifically, the control method further includes: starting the second subcooling circuit when the main circuit 110 is in operation. In this case, the second subcooling circuit plays a similar role to the second branch of the first subcooling circuit in the previous embodiment, and brings about similar effects. Therefore, a repeated description is omitted herein.

In addition, it should be noted that while particular order of steps may have been shown, disclosed, and claimed in the above particular embodiments, it is understood that some steps can be carried out, separated or combined in any order unless it is expressly indicated that they should be executed in the particular order.

The controller described above for performing the aforementioned method may involve several functional entities that do not necessarily have to correspond to physically or logically independent entities. These functional entities may also be implemented in software, or implemented in one or more hardware modules or integrated circuits, or implemented in different processing devices and/or microcontroller devices.

In the description, examples are used to disclose the present disclosure, including the best mode, with the purpose of enabling any person skilled in the art to practice the disclosure, including making and using any device or system and performing any of the methods covered. The scope of protection of the present disclosure is defined by the claims, and may include other examples that can be conceived by those skilled in the art. If such other examples have structural elements that do not differ from the literal language of the claims, or if they include equivalent structural elements that do not substantively differ from the literal language of the claims, these examples are also intended to be included in the scope of the claims.

What is claimed is:

1. An air conditioning system, comprising:

a main circuit having: a main compressor and an injector; a gas cooler connected between an exhaust port of the main compressor and a primary flow inlet of the injector; a gas-liquid separator connected between a suction port of the main compressor and an outlet of the injector; and a main throttling element and an evaporator connected between a liquid outlet of the gas-liquid separator and a secondary flow inlet of the injector; and a first subcooling circuit having: a first subcooling compressor, a first condenser, a first subcooling throttling element and a first subcooler connected in sequence;

wherein the first subcooler is further disposed in a flow path between the outlet of the injector and the gas-liquid separator in the main circuit.

2. The air conditioning system according to claim 1, wherein the first subcooling circuit further comprises a second subcooler which is connected in parallel with the first subcooler; and wherein the second subcooler is further disposed between the primary flow inlet of the injector and the gas cooler in the main circuit.

3. The air conditioning system according to claim 2, further comprising a second throttling element, wherein the second throttle element and the second subcooler are connected in parallel with the first throttling element and the first subcooler.

4. The air conditioning system according to claim 2, further comprising a back pressure valve connected in parallel with the first subcooler and disposed between the second subcooler and an suction port of the first subcooling compressor.

5. The air conditioning system according to claim 1, wherein the first subcooling circuit further comprises a second subcooler connected in series with the first subcooler; and wherein the second subcooler is further disposed between the primary flow inlet of the injector and the gas cooler in the main circuit.

6. The air conditioning system according to claim 1, further comprising a second subcooling circuit having a second subcooling compressor, a second condenser, a second subcooling throttling element, and a second subcooler connected in sequence; wherein the second subcooler is further disposed between the primary flow inlet of the injector and the gas cooler in the main circuit.

7. The air conditioning system according to claim 1, further comprising a suction line heat exchanger disposed in a flow path between the gas cooler and the primary flow inlet of the injector; wherein a refrigerant flowing out of a gas outlet of the gas-liquid separator flows into the suction port of the main compressor via the suction line heat exchanger.

8. The air conditioning system according to claim 1, further comprising a liquid pump disposed in a flow path between the liquid outlet of the gas-liquid separator and the secondary flow inlet of the injector.

9. The air conditioning system according to claim 8, wherein the liquid pump is disposed between the liquid outlet of the gas-liquid separator and the main throttling element.

10. The air conditioning system according to claim 1, wherein the refrigerant participating in the operation in the main circuit is a carbon dioxide refrigerant, and/or the refrigerant participating in the operation in the first subcooling circuit or the second subcooling circuit is a propane refrigerant.

* * * * *